US010759031B2

(12) United States Patent
Wong et al.

(10) Patent No.: US 10,759,031 B2
(45) Date of Patent: Sep. 1, 2020

(54) SUPPORT FOR ELASTOMERIC DISC VALVE IN COMBUSTION DRIVEN FASTENER HAND TOOL

(71) Applicant: Power Tech Staple and Nail, Inc., Monterey Park, CA (US)

(72) Inventors: Raymond Wong, Alhambra, CA (US); Shih-Yi Chen, Taoyuan (TW); Chin-Chuan Chen, Taoyuan (TW)

(73) Assignee: Power Tech Staple and Nail, Inc., Monterey Park, CA (US)

( * ) Notice: Subject to any disclaimer, the term of this patent is extended or adjusted under 35 U.S.C. 154(b) by 565 days.

(21) Appl. No.: 15/176,138

(22) Filed: Jun. 7, 2016

(65) Prior Publication Data

US 2016/0354908 A1 Dec. 8, 2016

Related U.S. Application Data

(60) Provisional application No. 62/172,783, filed on Jun. 8, 2015.

(51) Int. Cl.
*B25C 1/08* (2006.01)

(52) U.S. Cl.
CPC ..... *B25C 1/08* (2013.01)

(58) Field of Classification Search
CPC .. B25C 1/08; F15B 1/204; B25D 9/10; B23B 2215/247; B23B 45/048; B21J 7/26
USPC ..... 227/10, 130
See application file for complete search history.

(56) References Cited

U.S. PATENT DOCUMENTS 4,563,134 A * 1/1986 Hitzelberger ..... F04B 49/225 417/295
5,067,449 A * 11/1991 Bonde ..... F01M 13/00 123/41.86
5,601,112 A * 2/1997 Sekiya ..... F16K 15/148 137/512.15
5,626,274 A 5/1997 Shkolnikov et al.
5,680,980 A 10/1997 Robinson
5,687,899 A 11/1997 Dohi et al.
(Continued)

FOREIGN PATENT DOCUMENTS

WO WO2007/048006 A2 4/2007

OTHER PUBLICATIONS

PCT/US2016/036527 International Search Report and Written Opinion, dated Sep. 1, 2016.

*Primary Examiner* — Hemant Desai
*Assistant Examiner* — Christopher Robin Kim
(74) *Attorney, Agent, or Firm* — Canady & Lortz LLP; Bradley K. Lortz

(57) ABSTRACT

A valve support for use with a valve in a combustion driven fastener hand tool, the valve being formed by a flexible disc affixed to a central shaft having a circumferential edge resting against an anular valve seat affixed to a wall of a combustion chamber with the valve in a closed position is disclosed. The valve support comprises a plate affixed to the central shaft and against the flexible disc, the plate having one or more ports therethrough. In a closed position, the flexible disc has a circumferential edge resting against an anular valve seat affixed to a wall of a combustion chamber but also a central portion of the flexible disc is proximate or contacting a central portion of the support plate on the same side of the disc as the annular valve seat. Various port configuration are possible.

14 Claims, 9 Drawing Sheets

(56) References Cited

U.S. PATENT DOCUMENTS 5,713,313 A 2/1998 Berry
5,722,578 A * 3/1998 Van Erden ..... B25C 1/04 227/10
5,752,643 A * 5/1998 MacVicar ..... B25C 1/008 227/10
5,794,831 A 8/1998 Velan et al.
5,799,855 A 9/1998 Veoukas et al.
5,806,747 A 9/1998 Erden et al.
5,860,580 A 1/1999 Velan et al.
5,897,043 A 4/1999 Veoukas et al.
5,909,836 A 6/1999 Shkolnikov et al.
5,911,350 A 6/1999 Bolger et al.
5,971,245 A 10/1999 Robinson
5,975,397 A 11/1999 Van Erden et al.
5,975,569 A 11/1999 Starozhitsky et al.
6,012,622 A 1/2000 Weinger et al.
6,102,270 A 8/2000 Robinson
6,108,908 A 8/2000 Starozhitsky et al.
6,109,165 A 8/2000 Velan et al.
6,145,723 A 11/2000 Gupta
6,145,724 A 11/2000 Shkolnikov et al.
6,164,510 A 12/2000 Deiso et al.
6,176,412 B1 1/2001 Weinger et al.
6,179,192 B1 1/2001 Weinger et al.
6,318,646 B1 * 11/2001 Mattioli ..... F02M 51/0671 239/585.1
6,520,397 B1 2/2003 Moeller
6,523,860 B1 2/2003 Shkolnikov et al.
6,584,945 B2 7/2003 Porth
6,619,527 B1 9/2003 Moeller
6,626,344 B2 9/2003 Shkolnikov et al.
6,671,163 B2 12/2003 Shkolnikov et al.
6,685,193 B2 2/2004 Roberts et al.
6,715,655 B1 4/2004 Taylor et al.
6,722,550 B1 4/2004 Ricordi et al.
6,755,159 B1 6/2004 Adams et al.
6,796,476 B2 9/2004 Birk et al.
6,796,478 B2 9/2004 Shkolnikov et al.
6,827,105 B1 * 12/2004 Marble ..... F16K 15/148 137/246
6,840,033 B2 1/2005 Adams
6,860,243 B2 3/2005 Doherty et al.
6,863,045 B2 3/2005 Ricordi
6,892,524 B1 5/2005 Van Erden et al.
6,938,810 B2 9/2005 Robinson
6,964,362 B2 11/2005 Shkolnikov et al.
6,966,478 B2 11/2005 Adams et al.
7,040,520 B2 5/2006 Turk
7,040,521 B2 5/2006 Kolodzej et al.
7,107,944 B1 9/2006 Heinzen
7,118,018 B2 10/2006 Turk
7,124,923 B2 10/2006 Panasik
7,140,331 B1 11/2006 Heinzen
7,163,134 B2 1/2007 Moeller et al.
7,201,301 B2 4/2007 Moeller et al.
7,201,302 B2 4/2007 Panasik et al.
7,222,765 B2 5/2007 Robinson
7,275,505 B2 10/2007 Moeller et al.
7,296,719 B1 11/2007 Taylor et al.
7,299,963 B2 11/2007 Moeller et al.
7,314,025 B2 1/2008 Shkolnikov et al.
7,341,171 B2 3/2008 Moeller et al.
7,383,974 B2 6/2008 Moeller et al.
7,392,922 B2 7/2008 Vanstaan et al.
7,431,185 B2 10/2008 Moeller et al.
7,438,090 B2 * 10/2008 Steele ..... F16K 15/141 137/854
7,478,740 B2 1/2009 Shea et al.
7,487,898 B2 2/2009 Moeller et al.
7,497,271 B2 3/2009 Moeller et al.
7,510,105 B2 3/2009 Moeller et al.
7,568,602 B2 8/2009 Turk
7,584,723 B2 9/2009 Shkolnikov et al.
7,587,897 B2 9/2009 Strong
7,588,096 B2 9/2009 Panasik
7,591,236 B2 9/2009 Moeller et al.
7,591,249 B2 9/2009 Wagdy et al.
7,603,854 B2 10/2009 Strong
7,617,957 B2 11/2009 Holderfield et al.
7,654,429 B2 2/2010 Shea et al.
7,661,568 B2 2/2010 Vanstaan et al.
7,673,779 B2 3/2010 Moeller et al.
7,757,920 B2 7/2010 Shea et al.
7,770,772 B2 8/2010 Adams
7,784,560 B2 8/2010 Mina et al.
7,802,500 B2 9/2010 Kolodziej et al.
7,841,501 B2 11/2010 Panasik et al.
7,866,519 B2 1/2011 Cortez, Jr.
7,918,375 B2 4/2011 Johnson et al.
7,926,733 B2 4/2011 Micheli
7,938,104 B2 5/2011 Adams
7,946,463 B2 5/2011 Moeller
8,016,046 B2 9/2011 Zhao et al.
8,042,718 B2 10/2011 Taylor et al.
8,070,031 B2 12/2011 Moeller et al.
8,087,394 B2 1/2012 Adams
8,152,038 B2 4/2012 Rouger et al.
8,191,751 B2 6/2012 Moeller et al.
8,205,582 B2 * 6/2012 Adams ..... B25C 1/08 123/46 R
8,220,686 B2 7/2012 Kestner et al.
8,261,847 B2 9/2012 Ford et al.
8,276,798 B2 10/2012 Moeller et al.
8,302,831 B2 11/2012 Taylor et al.
8,302,832 B2 11/2012 Porth et al.
8,313,545 B2 11/2012 Panasik et al.
8,336,749 B2 12/2012 Largo
8,347,832 B2 1/2013 Adams
8,348,118 B2 1/2013 Segura
8,376,204 B2 2/2013 Buetow et al.
8,511,264 B2 8/2013 Adams
8,523,037 B2 9/2013 Segura
D691,012 S 10/2013 Buetow et al.
8,579,175 B2 11/2013 Mina
8,622,315 B2 * 1/2014 Ravenhill ..... F02M 61/047 239/91
2002/0134069 A1 * 9/2002 Adams ..... B25C 1/08 60/39.6
2002/0144498 A1 * 10/2002 Adams ..... B25C 1/08 60/39.6
2005/0121491 A1 * 6/2005 Chang ..... B25C 1/047 227/130
2008/0011806 A1 1/2008 Kitagawa
2009/0057365 A1 3/2009 Murayama et al.
2011/0088811 A1 * 4/2011 Shudo ..... F02M 21/0212 141/248
2012/0210974 A1 * 8/2012 Adams ..... F02B 19/14 123/253
2012/0286014 A1 11/2012 Pedicini et al.
2014/0150905 A1 * 6/2014 Sparazynski ..... F16K 15/141 137/512
2014/0239566 A1 * 8/2014 Kok ..... B25F 5/006 267/140.3
2015/0122340 A1 * 5/2015 Edelmayer ..... F01L 9/02 137/12
2015/0369118 A1 * 12/2015 Adams ..... F01B 11/04 123/274
2016/0059398 A1 * 3/2016 Wong ..... F02B 19/1023 227/10
2016/0354908 A1 * 12/2016 Wong ..... B25C 1/08
2017/0030301 A1 * 2/2017 Fujisaki ..... F02M 25/0836
2017/0203425 A1 * 7/2017 Herelier ..... F02B 63/02
2018/0036871 A1 * 2/2018 Cordeiro ..... B25C 1/08

* cited by examiner

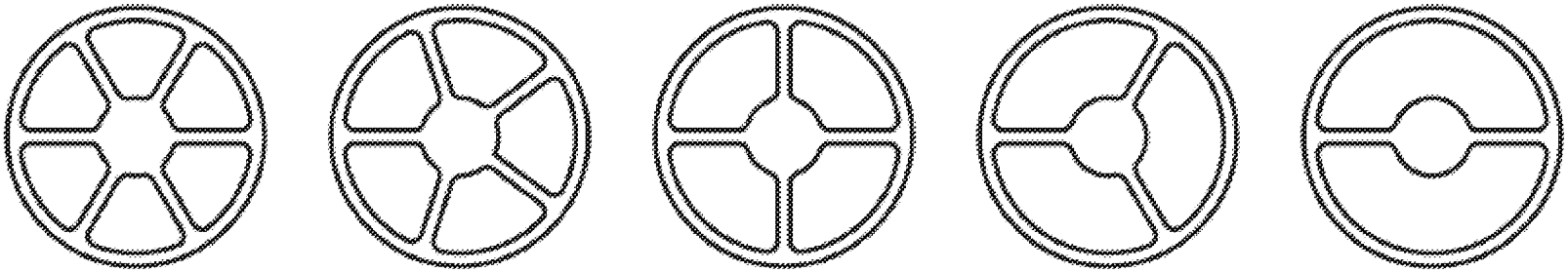
FIG. 6A
FIG. 6B
FIG. 6C
FIG. 6D
FIG. 6E
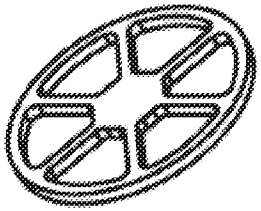
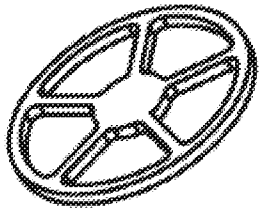
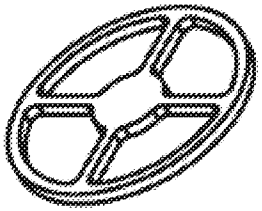
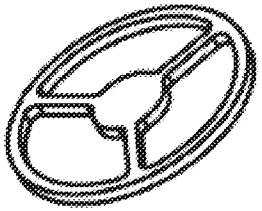
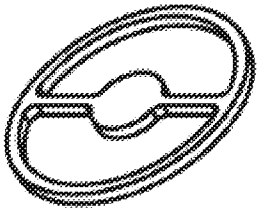

SUPPORT FOR ELASTOMERIC DISC VALVE IN COMBUSTION DRIVEN FASTENER HAND TOOL

CROSS-REFERENCE TO RELATED APPLICATIONS

This continuation-in-part application claims the benefit under 35 U.S.C. § 120 of the following co-pending and commonly-assigned U.S. utility patent application:

U.S. patent application Ser. No. 14/839,765, filed Aug. 28, 2015, by Wong et al. and entitled "COMBUSTION DRIVEN FASTENER HAND TOOL," which claims the benefit of U.S. Provisional Patent Application Ser. No. 62/043,297, filed Aug. 28, 2014, and entitled "COMBUSTION DRIVEN FASTENER HAND TOOL," which applications are both incorporated by reference herein.

This application claims the benefit under 35 U.S.C. § 119(e) of the following U.S. provisional patent application, which is incorporated by reference herein:

U.S. Provisional Patent Application No. 62/172,783, filed Jun. 8, 2015, and entitled "SUPPORT FOR ELASTOMERIC DISC VALVE IN COMBUSTION DRIVEN FASTENER HAND TOOL," by Wong et al.

BACKGROUND OF THE INVENTION

1. Field of the Invention

This invention relates to combustion driven fastener hand tools. Particularly, this invention relates to a combustion driven fastener hand tools having a control valve between two portions of a combustion chamber.

2. Description of the Related Art

Powered fastener driving tools, e.g. nail guns, have existed for decades. Perhaps not coincidentally, the first commercial nail gun was introduced in 1950 after World War II wherein the technology for rapidly firing projectiles was greatly advanced. The first nail guns were pneumatic, driven by compressed air. Although pneumatic power is still the most prevalent, over time fastener driving tools have been developed using other means of power, such as electric motors, solonoids, combustibles, e.g gas or explosive powder, have also been developed. Some development of technology related to powered fastener drivers, and particularly combustion driven fastener tools has occurred. However, there is still much need for further development.

Combustion driven fastener hand tools employing combustibles, e.g. gas or powder, to force a piston driver against a fastener introduce a unique set of parameters which must be properly balanced in order to achieve a working device. Sizing of the combustion chamber and valving are critical, in addition to the fuel delivery and mixing components. Moreover, greater optimization of a given design to improve power and efficiency can be greatly affected through precise understanding of the combustion process. For example, it has been determined that using a combustion chamber divided into portions having a control plate therebetween can greatly improve the efficiency and power of a combustion driven fastener device. In addition, it has also been previously observed that accurate location of the starting position of the driving piston can be important in the operation of a combustion driven device, particularly if the piston is heavy and likely to move under its own weight.

U.S. Pat. No. 8,925,517, issued Jan. 6, 2015, by Adams, which is incorporated by reference herein, discloses a gas-powered tool motor includes a combustion chamber with an intake valve at one end, an exhaust valve at another end, and a control plate or control valve between two portions of the combustion chamber. A piston or other positive displacement device is in communication with the combustion chamber. The intake and exhaust valves have closure members that are movable along a common axis in tandem between collective open positions for recharging the combustion chamber with the fuel and air mixture and collective closed positions for detonating the fuel and air mixture in the combustion chamber and displacing the positive displacement device. The control plate or control valve supports limited air flows from a first portion of the combustion chamber to a second portion of the combustion chamber even in the closed position of the control valve for supporting two-stage combustion.

Adams teaches use of a control valve between two portions of a combustion chamber having a closure member affixed to a central shaft (which moves axially to open and close the valve) and a control seat and forming a gap therebetween in the closed position. Upon combustion (with the control valve close) in the first portion of the combustion chamber, the flame front moves towards the gap, preferably driving a fuel/air mixture through the gap and compressing the combined fuel/air mixture in the second portion of the combustion chamber just prior to ignition in the second portion of the combustion chamber yielding more power to the fastener driver than would otherwise be elicited from an undivided combustion chamber burning the same amount of fuel.

Alternately, Adams teaches a control valve comprising a spring-loaded poppet having a closure member which moves along a central shaft and has a chamfered edge biased against a mating control valve seat affixed to the combustion chamber wall. The flame front moving through the first combustion chamber portion overcomes the spring bias and opens the valve, preferably driving a fuel/air mixture through the gap and compressing the combined fuel/air mixture in the second portion of the combustion chamber just prior to ignition in the second portion of the combustion chamber. Combustion in the second portion of the chamber then closes the valve.

Adams also discloses use of an alternate control plate affixed to a central shaft (which moves axially to open and close the valve) which forms an anular gap between the plate and the cylinder wall which functions similar to the gap between the closure member and the control seat of the control valve described above. Limited size openings may additionally be made through the control plate to support limited flow through the control plate. In a similar manner, the control plate can alternately be affixed to the cylinder wall allowing a central shaft to move freely through a central orifice of the control plate. In this case, limited flow through the control plate is formed solely by limited size openings through the plate.

The various control valve and control plate embodiments taught by Adams either yield equivalent flow in both directions with the valve in the closed position, i.e. between the closure member and seat or the control plates, or require additional moving parts and complexity, i.e. the poppet valve having a spring and control plate moving on the tie rod, which could limit life of the device being subject to combustion gases. A closed control plate, even one with orifices, as taught by Adams serves to block combustion pressure between the two portions of the combustion chamber.

In view of the foregoing, there is a need in the art for control valve apparatuses and methods for operation between the two portions of the combustion chamber within a combustion driven fastener hand tools. There is a need for such devices to improve efficiency and delivered driving power. There is also a need for such apparatuses and methods that operate reliably and efficiently over many uses and at a reduced cost. These and other needs are met by the present invention as detailed hereafter.

SUMMARY OF THE INVENTION

A valve support for use with a valve in a combustion driven fastener hand tool, the valve being formed by a flexible disc affixed to a central shaft having a circumferential edge resting against an anular valve seat affixed to a wall of a combustion chamber with the valve in a closed position is disclosed. The valve support comprises a plate affixed to the central shaft and against the flexible disc, the plate having one or more ports therethrough. In a closed position, the flexible disc has a circumferential edge resting against an anular valve seat affixed to a wall of a combustion chamber but also a central portion of the flexible disc is proximate or contacting a central portion of the support plate on the same side of the disc as the annular valve seat. Various port configuration are possible.

A typical embodiment of the invention comprises a combustion driven hand tool having a control valve between two portions of a combustion chamber in a combustion driven hand tool including a flexible disc affixed to a movable central shaft, wherein the control valve is disposed in an open position with a circumferential edge of the flexible disc distal from a valve seat on a wall of the combustion chamber and control valve is disposed in a closed position with the circumferential edge of the flexible disc contacting the valve seat, the control valve comprising a plate affixed to the movable central shaft adjacent the flexible disc and disposed on a same side of the flexible disc as the valve seat to support the flexible disc with the control valve in the closed position such that the flexible disc does not collapse by the valve seat under reverse pressure and one or more ports through the plate such that the one or more ports allow combustion pressure to flow freely between the two portions of the combustion chamber with the control valve in the closed position under forward combustion pressure. The central shaft can comprise two parts coupled together with the flexible disc and the plate sandwiched therebetween. In addition, a crossbar can be disposed on the central shaft adjacent to the flexible disc opposite the plate.

The plate can comprises one or more radial spokes having the one or more ports therebetween. The one or more radial spokes can extend to a circumferential ring. In addition, a plurality of radial segments can extend from the circumferential ring toward a center of the plate. In other embodiments, the plate can comprise a plurality of parallel slots therethrough forming the ports or a plurality of circular holes therethrough forming the ports.

A typical method embodiment of the invention for controlling combustion in a combustion driven hand tool having a control valve between two portions of a combustion chamber in a combustion driven hand tool including a flexible disc affixed to a movable central shaft, wherein the control valve is disposed in an open position with a circumferential edge of the flexible disc distal from a valve seat on a wall of the combustion chamber and control valve is disposed in a closed position with the circumferential edge of the flexible disc contacting the valve seat, the method comprising the steps of affixing a plate to the movable central shaft adjacent the flexible disc and disposed on a same side of the flexible disc as the valve seat to support the flexible disc with the control valve in the closed position, allowing combustion pressure to flow freely between the two portions of the combustion chamber with the control valve in the closed position under forward combustion pressure through one or more ports through the plate, and supporting the flexible disc with the plate such that the flexible disc does not collapse by the valve seat under reverse pressure. This method embodiment for controlling combustion in a combustion driven hand tool can be modified consistent with the other apparatuses and methods described herein.

An alternate embodiment of the invention can comprises a combustion driven hand tool having a control valve between two portions of a combustion chamber, the control valve comprising a central shaft axially movable within in the combustion chamber, the combustion chamber divided into two portions separated by a valve seat on a wall of the combustion chamber, a flexible disc affixed to the central shaft such that the central shaft is movable to dispose to the control valve in an open position with a circumferential edge of the flexible disc distal from the valve seat and in a closed position with the circumferential edge of the flexible disc contacting the valve seat, a plate affixed to the movable central shaft and adjacent the flexible disc to support the flexible disc with the control valve in the closed position such that the flexible disc does not collapse by the valve seat under reverse combustion pressure, and one or more ports through the plate such that the one or more ports allow combustion pressure to flow freely between the two portions of the combustion chamber with the control valve in the closed position under forward combustion pressure. This combustion driven hand tool embodiment can be modified consistent with the other apparatuses and methods described herein.

Another embodiment of the invention comprises a combustion driven hand tool, including a combustion chamber means for containing and directing combustion gases to drive a fastener, the combustion chamber means divided into two portions separated by a valve seat, a central shaft axially movable within in the combustion chamber means, a plate affixed to the movable central shaft and adjacent the flexible disc to support the flexible disc with the control valve in the closed position such that the flexible disc does not collapse by the valve seat under reverse combustion pressure, and one or more ports through the plate such that the one or more ports allow combustion pressure to flow freely between the two portions of the combustion chamber means with the control valve in the closed position under forward combustion pressure. This combustion driven hand tool embodiment can be modified consistent with the other apparatuses and methods described herein.

Yet another embodiment of the invention comprises a combustion driven hand tool having a control valve between two portions of a combustion chamber, the control valve including a central shaft axially movable within in the combustion chamber, the combustion chamber divided into two portions separated by a valve seat on a wall of the combustion chamber and a flexible disc affixed to the central shaft such that the central shaft is movable to dispose to the control valve in an open position with a circumferential edge of the flexible disc distal from a valve seat affixed to a wall of the combustion chamber and in a closed position with the circumferential edge of the flexible disc contacting the valve seat affixed to the wall of the combustion chamber. Contact between the circumferential edge of the flexible disc and the valve seat with the control valve in the closed position limits reverse pressure to a first portion of the combustion chamber. The flexible disc can comprise an elastomer. In addition, a crossbar can be disposed on the central shaft adjacent to the flexible disc opposite the plate. This combustion driven hand tool embodiment can be modified consistent with the other apparatuses and methods described herein.

BRIEF DESCRIPTION OF THE DRAWINGS

Referring now to the drawings in which like reference numbers represent corresponding parts throughout:

FIGS. 6A to 6E illustrate plates employing a plurality of ports separated by a plurality of radial segments;

DETAILED DESCRIPTION OF THE PREFERRED EMBODIMENT

1. Overview

Figure 1A:
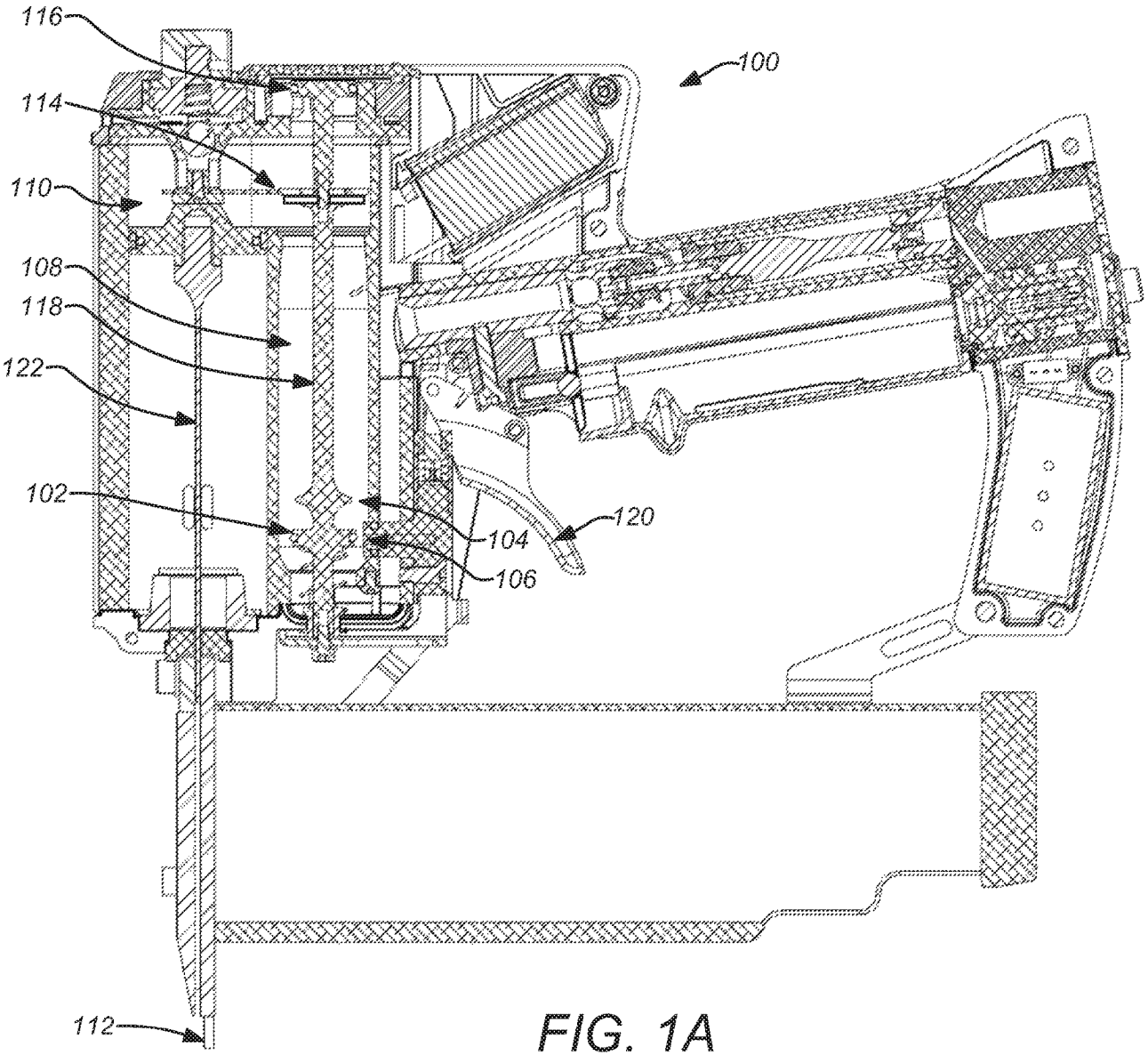
FIGS. 1A and 1B show cutaway views of a fuel charging operation of an exemplary combustion driven fastener hand tool for use with an embodiment of the invention.

As previously mentioned, a valve support for use with a valve in a combustion driven fastener hand tool, the valve being formed by a flexible disc affixed to a central shaft having a circumferential edge resting against an anular valve seat affixed to a wall of a combustion chamber with the valve in a closed position is disclosed. The valve support comprises a plate affixed to the central shaft and against the flexible disc, the plate having one or more ports therethrough. In a closed position, the flexible disc has a circumferential edge resting against an anular valve seat affixed to a wall of a combustion chamber but also a central portion of the flexible disc is proximate or contacting a central portion of the support plate on the same side of the disc as the annular valve seat. Various port configuration are possible.

It should be noted that although example embodiments of the invention are shown herein applied to a combustion driven fastener hand tool which operates using a combustion chamber divided in portions separated by a control valve or plate and charged with a gas and air mixture, e.g. as described in U.S. Pat. No. 8,925,517 by Adams, which is incorporated by reference herein, embodiments of the invention are not limited to this type of combustion chamber or fuel. Instead, embodiments of the invention may be employed with any known divided combustion chamber that requires a valve between different portions of the combustion chamber where the valve is required to allow flow of combusting gases in one direction and resist flow of combusting gases in the opposite direction. Thus, devices using divided combustion chambers in any other known application can be used with embodiments of the invention as will be understood by those skilled in the art.

One important feature of embodiments of the present invention is that the one or more ports in the support plate are designed to allow combustion pressure to freely pass between the two portions of the combustion chamber. Prior art devices such as described in U.S. Pat. No. 8,925,517 employ valve plates between the two portions of the combustion chamber. However, these valve plates are design to restrict or block combustion. Even if such valve plates include orifices, the orifices are only to allow ignition to be transmitted from the pre-combustion chamber to the main combustion chamber. Such orifices might allow pressure to equalize over time between the two portions of the combustion chamber, but combustion pressure is much faster. Accordingly, such prior art valve plates, even with orifices, does not allow combustion pressure to freely pass between the two portions of the combustion chamber. Moreover, even if orifices of sufficient size to allow combustion pressure to freely pass between the two portions of the combustion chamber were employed in such prior art valve plates, they would defeat the purpose of the valve plates by allowing reverse pressure to return to the pre-combustion chamber. In contrast, the embodiments of the present invention support a flexible disc valve which separately blocks reverse pressure.

2. Exemplary Combustion Driven Fastener Hand Tool

Figure 1B:
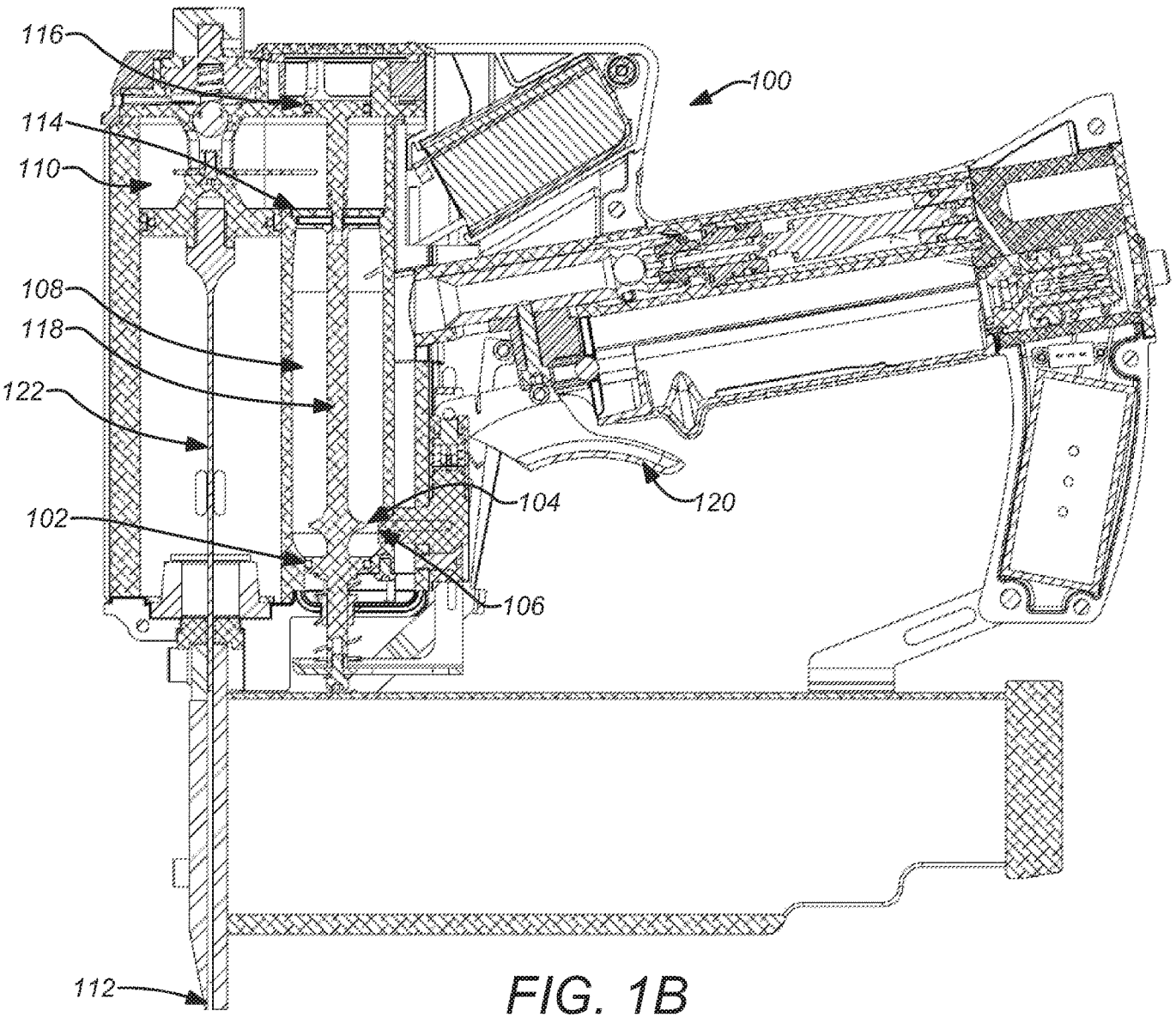

FIGS. 1A and 1B illustrate cutaway views of a fuel charging operation of an exemplary combustion driven fastener hand tool 100 for use with an embodiment of the invention. FIG. 1A shows the combustion chamber inlet valve 102 in the open position with the valve stem disc 104 for spark generation. Note that the valve stem disc is disposed above the spark point 106 of the igniter component. Both combustion chamber portions 108, 110 are charged with a fuel/air mixture when pressure is applied to the safety 112 as the user presses the head of the tool against a surface. The inlet chamber valve 102, the control valve 114, and the charging exhaust valve 116 are all disposed on a common central shaft 118. The trigger 120 is mechanically linked to the central shaft such that all the valves 102, 114, 116 are moved to the closed positions together by the user pulling the trigger 120 toward the hand grip as shown in FIG. 1B. With the valves 102, 114, 116 in the closed positions, the valve stem disc 104 is disposed in line with the spark point 106 of the igniter component providing the closest separation for spark generation. In this position, a flexible disc of the control valve 114 and affixed to the central shaft 118 is disposed with a circumferential edge against a valve seat affixed to the combustion chamber wall. A support for the control valve is also affixed to the central shaft 118 and disposed below the flexible disc.

With the valves as shown in FIG. 1B, combustion is ignited in the lower portion 108 of the combustion chamber (which may also be termed the pre-combustion chamber). The high speed combustion gases under forward pressure drive past the flexible disc of the control valve 114, further pressurizing and igniting the fuel and air within the second portion 110 of the combustion chamber (which may also be termed the main combustion chamber). Upon ignition in the second portion 110 of the combustion chamber reverse pressure flow to the lower portion 108 is blocked by the control valve 114 improving the overall power output of the tool. Combustion within the chamber second portion 110 forces the driver 122 downward driving a fastener into the surface below the head.

Figure 2:
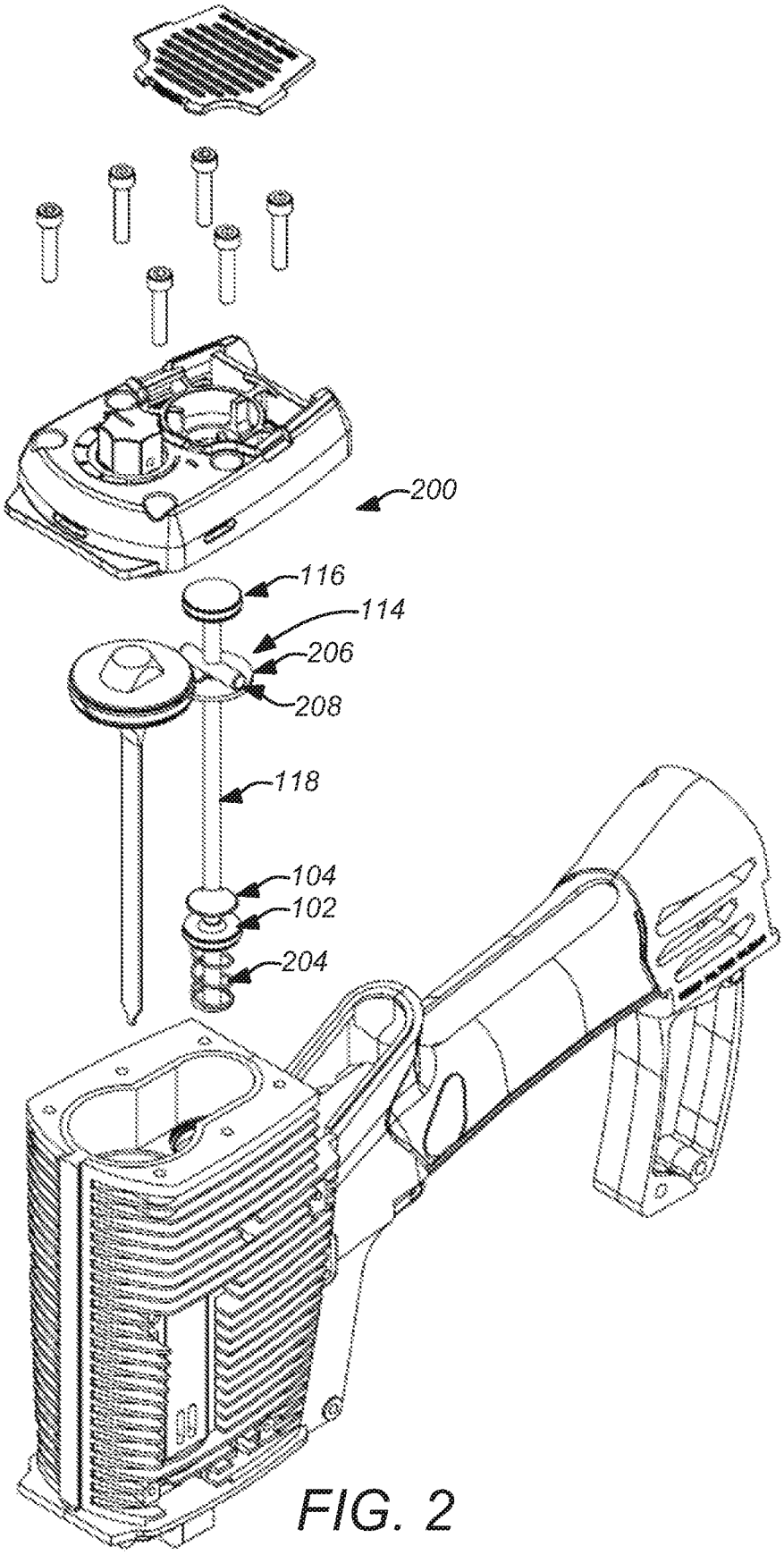
FIG. 2 is an exploded view of an exemplary dual combustion chamber assembly of an exemplary combustion driven fastener hand tool for use with an embodiment of the invention.

FIG. 2 is an exploded view of an exemplary dual combustion chamber assembly 200 of an exemplary combustion driven fastener hand tool for use with an embodiment of the invention. The inlet, control and charge exhaust valve assembly 202 comprises the central shaft 118 having a spring 204 to hold the assembly 202 with the valves in a normally open position. Affixed to the central shaft 118 are the chamber inlet valve 102, the valve stem disc 104 for spark generation, the flexible disc 206 for the control valve 114 and the charging exhaust valve 116. The control valve 114 also includes an optional crossbar 208 which can help control the form the flexible disc takes when allowing combustion gases through.

3. Support Plate for Flexible Disc Control Valve

Figure 3:
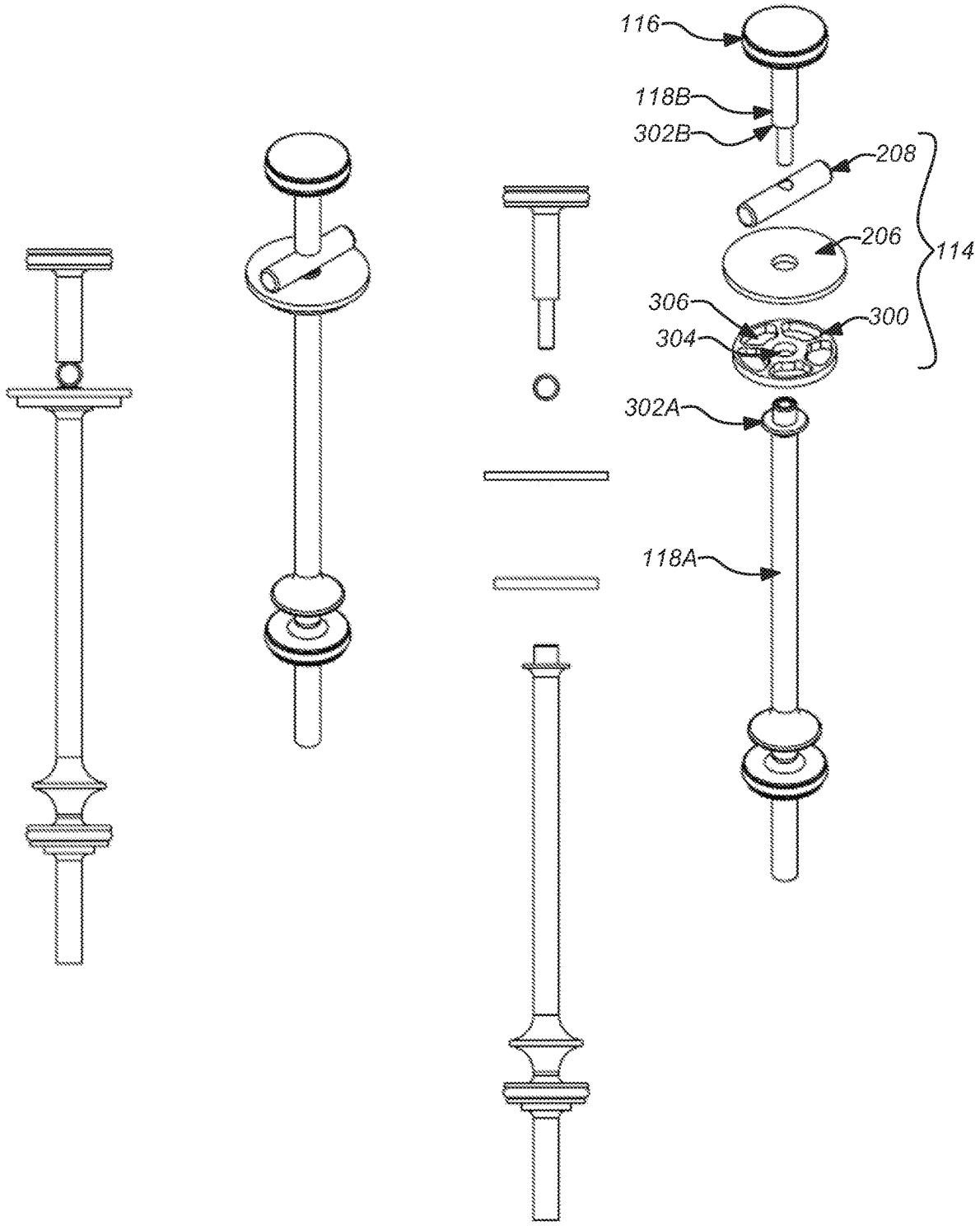
FIG. 3 shows assembled and exploded views of an exemplary valve assembly embodiment of an exemplary combustion driven fastener hand tool.

FIG. 3 shows assembled and exploded views of an exemplary valve assembly 202 embodiment of an exemplary combustion driven fastener hand tool. The assembly 202 can be made from two parts 118A, 118B of the central shaft 118. The combustion chamber inlet valve 102 and the valve stem disc 104 for spark generation can be machined directly onto the lower part 118A of the central shaft 118 and the charging exhaust valve 116 can be machined directly onto the upper part 118B of the central shaft 118. The two parts 118A, 118B can be assembled together, e.g. at a threaded, bonded or press-fit joint or any other suitable type of joint, with the components of the control valve 114 sandwiched in the joint between flanges (or stepped surfaces) 302A, 302B on each part 118A, 118B of the central shaft 118. The control valve 114 comprises the support plate 300 below the flexible disc 206. The support plate 300 comprises one or more ports 304 through the plate 300. Above the flexible disc 206 is the optional crossbar 208.

Figure 4:
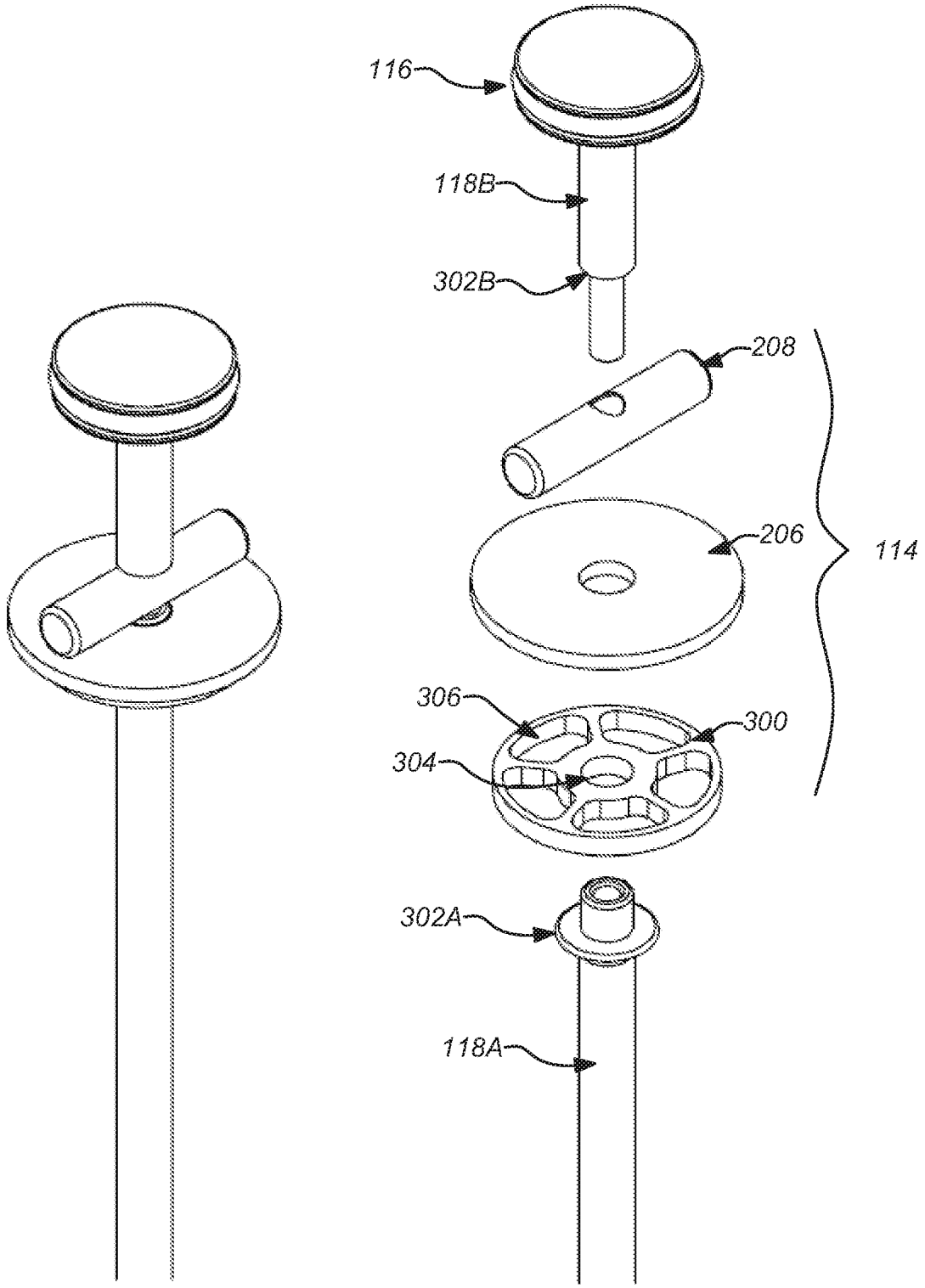
FIG. 4 shows closeups of assembled and exploded views of an exemplary valve assembly embodiment of an exemplary combustion driven fastener hand tool.

FIG. 4 shows closeups of assembled and exploded views of the control valve 114 of an exemplary valve assembly 202 embodiment of an exemplary combustion driven fastener hand tool. In this example, the support plate 300 comprises a disc having a smaller diameter than that of the flexible disc 206 such that the diameter of the flexible disc extends beyond the support plate 300 to the valve seat of the combustion chamber wall. The support plate 300 includes a central through hole 304 to receive the central shaft 118 and secure the support plate 300 in the stack of control valve 114 components. The support plate 300 also includes multiple ports 306 through the support plate 300. The ports through the plate 300 allow combustion from the lower portion 108 of the combustion chamber to flow freely to the upper portion 110 of the combustion chamber.

In this example, the support plate comprises five equal semicircular sections. In some alternate embodiments, the ports can be open shapes, rather than closed shapes, such that the overall support plate 300 is in the form of the spokes of a wheel without a rim. Any combination of open and closed shapes can be used to form the ports 306 through the support plate 300. In general, a balance between the thickness of the plate, the number and size of the ports 306, the thickness of the segments between the ports, and the material properties is made. The support plate 300 must be strong enough to support the flexible disc 206 and allow it form a suitable seal against the valve seat outside the circumference of the plate 300 under reverse combustion pressure as will be understood by those skilled in the art.

Figure 5A:
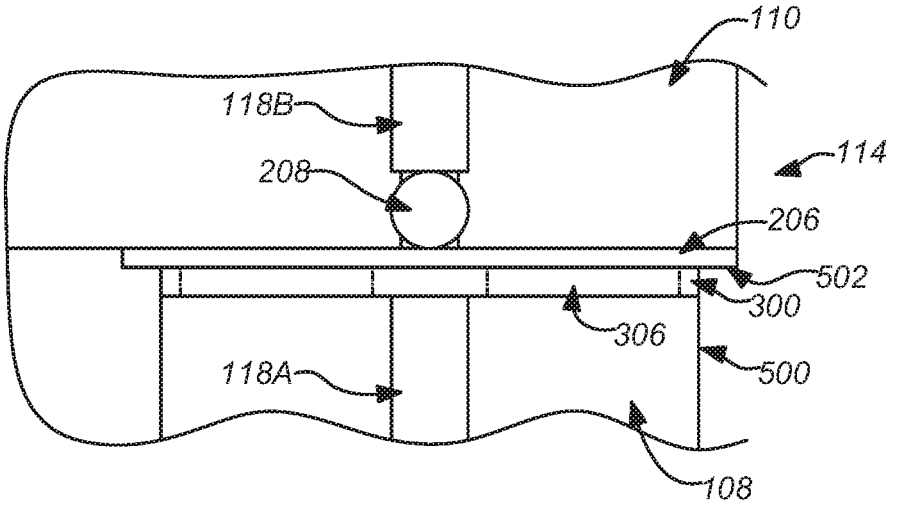
FIGS. 5A and 5B show operation of an exemplary valve assembly with a valve support embodiment for an exemplary combustion driven fastener hand tool.
Figure 5B:
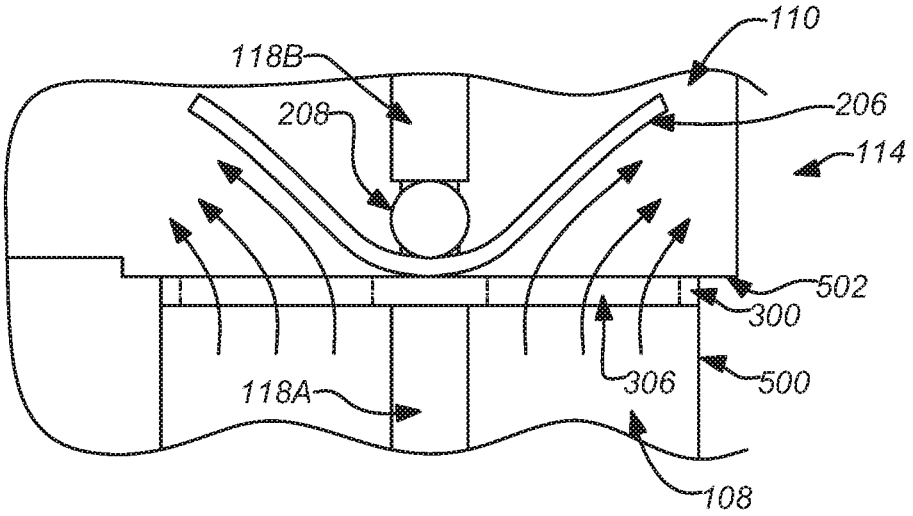

FIGS. 5A and 5B show operation of an exemplary valve assembly with a valve support embodiment for an exemplary combustion driven fastener hand tool. Both FIGS. 5A and 5B show the control valve 114 in a closed position. In the closed position, ideally the control valve 114 functions as a one-way valve allowing forward combustion flow from the lower portion 108 of the combustion chamber to the upper portion 110 of the combustion chamber and limiting (ideally, preventing) combustion flow in the reverse direction.

FIG. 5A shows the flexible disc 206 having a circumferential edge resting against a seat of the combustion chamber wall 500. The seat is formed by a step 502 in the combustion chamber wall 500. In FIG. 5A, the flexible disc 206 is shown as it would appear either under no pressure or, as it would ideally appear under reverse combustion pressure from the upper portion 110 of the combustion chamber. In reality some leakage may occur from the upper portion 110 to the lower portion 108 under reverse combustion pressure. The support plate 300 below the flexible disc 206 significantly limits reverse flow as it prevents the flexible disc 206 from collapsing by the valve seat into the lower portion 108 of the combustion chamber under combustion pressure from the upper portion 110 of the combustion chamber.

FIG. 5B shows the flexible disc affixed at a central point to the central shaft 118 under forward combustion pressure from the lower portion 108 of the combustion chamber. This is the condition of the flexible disc 206 under forward pressure from the lower portion 108 of the combustion chamber. Under these conditions, the combustion flame front is forcing an air/fuel mixture through the one or more ports 306 in the support plate 300 of the control valve 114 from the lower portion 108 to the upper portion 110 of the combustion chamber and causing the flexible disc 206 to bend upward at the edge about a central valley which forms around the crossbar 208. As a consequence of the moving flame front driven by combustion originating in the lower portion 108 of the combustion chamber, ignition of the air/fuel in the upper portion 110 of the combustion chamber occurs at a higher initial pressure, improving power delivered to the fastener from the combustion in the upper portion 110 of the combustion chamber.

It is important to note that the support plate 300 alone does not inhibit pressure flow of any type, i.e. from a low pressure gradient or high speed combustion gases, or any direction (forward or reverse) between the two portions of the combustion chamber with the control valve 114 in the closed position. The ports 306 provide too much passage to inhibit any pressure differential. However, with the control valve 114 in the closed position, high speed combustion gases under reverse pressure (i.e. that would otherwise return to the lower portion 108 of the combustion chamber) are blocked by the flexible disc 206 seal against the valve seat.

The crossbar 208 is an optional component in the control valve 114 which can assist to maintain the shape of the flexible disc 206 under combustion flow from the lower portion 108. If a crossbar 208 is employed, however, the ports 306 of the support plate 300 can be optimally configured such that some material of the plate forms a line directly under and aligned with the crossbar when assembled, e.g. like two colinear spokes extending from opposite sides of a central hub. This is because this line under the valley of the crossbar is substantially closed in all cases, so it is preferable to maximize support in this area.

The material of the support can be any suitable structural material that can survive the temperatures and combustion and provide adequate support to the flexible disc. For example, aluminum and steel or any suitable alloy thereof can be employed. However, other materials such as composites and heat resistance plastics are also possible. Suitable materials for the flexible disc must similarly survive the temperatures and combustion without deteriorating. However, in this case the material must also have the requisite flexibility for the application. Elastomeric materials such as silicone, fluorocarbon, flurosilicone, buna, ethylene-propylene, neoprene, chloroprene, and other suitable rubber and polymer materials can be used.

FIGS. 6A to 6L show exemplary alternate port configurations of the plate 300 for various embodiments of the invention in top and isometric views. (Note that in all cases the center of the plate 300 has a hole for mounting to the central shaft 118 that is not shown.) Various port designs are possible based upon the particular application. These examples are shown to illustrate possible configurations without limitation to particular sizes or numbers of elements used. It is most important to design the ports to allow free forward combustion flow but also provide sufficient supports for the flexible disc to limit or prevent reverse combustion flow. As previously mentioned, for applications employing a crossbar 208, it may be best to align the crossbar 208 with the supports of the plate 300 if possible, e.g. a cross lined up radial supports if an even number are present.

FIGS. 6A to 6E illustrate plates employing a plurality of ports separated by a plurality of radial segments extending to a circumferential ring. Each port comprises an annular section through the plate. Although the examples show six, five, four, three and two ports respectively in FIGS. 6A to 6E, those skilled in the art will appreciate that a plate having any number of ports can be produced in this configuration.

Figures 6F, 6G, 6H, 6I, 6J:
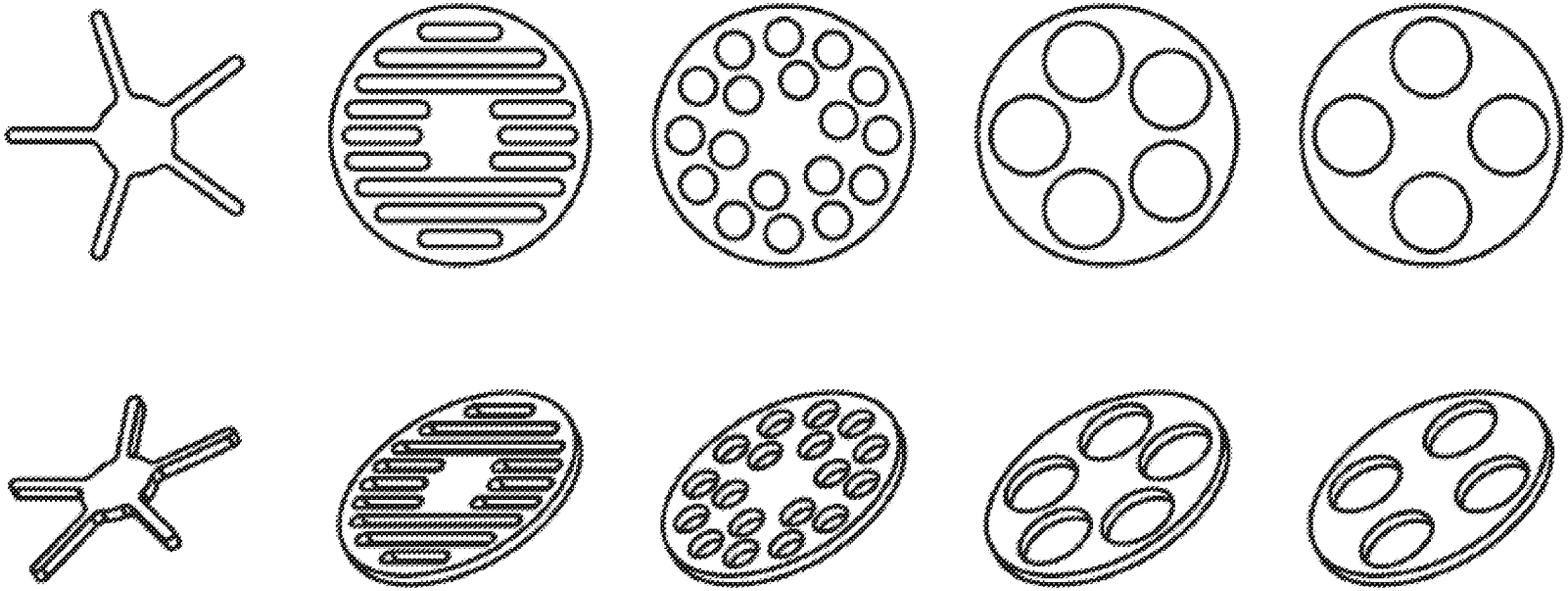
FIG. 6F illustrates a plate employing only spoke supports without a circumferential ring.
FIG. 6G illustrates a plate having a series of parallel slots therethrough.
FIGS. 6H to 6K illustrate example plates employing a plurality of circular holes of different numbers and sizes.
Figure 6K:
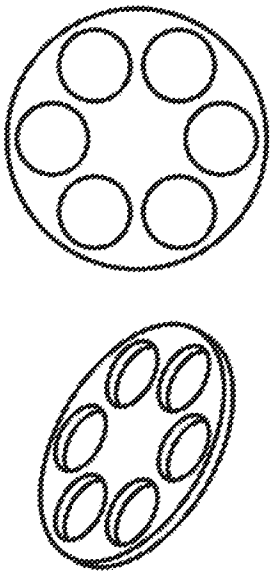

FIG. 6F shows a novel design for a plate employing only spoke supports without a circumferential ring. In this case, the flexible disc is annularly supported only by the valve seat. Although five spoke supports are shown, any plurality of spokes of any suitable thickness and width may be used.

FIG. 6G illustrates a plate having a plurality of parallel slots therethrough. Here also any suitable number of slots and size (width and length) may be used.

FIGS. 6H to 6K illustrate example plates employing a plurality of circular holes of different numbers and sizes. The example plates have eighteen, five, four, and six circular ports symmetrically spaced around the plate, respectively. Different size circular holes (or other shapes) can also be used on a single plate as well.

Figure 6L:
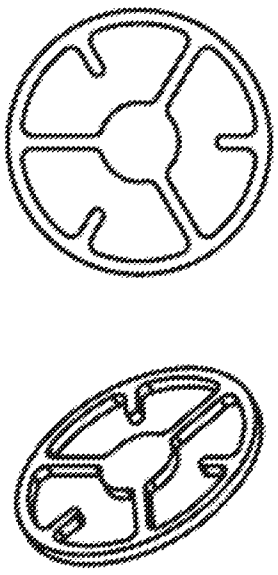
FIGS. 6L and 6M illustrate example plates employing a combination of radial spokes extending from the center to a circumferential ring and also a plurality of spoke segments extending from the circumferential ring toward the center.
Figure 6M:
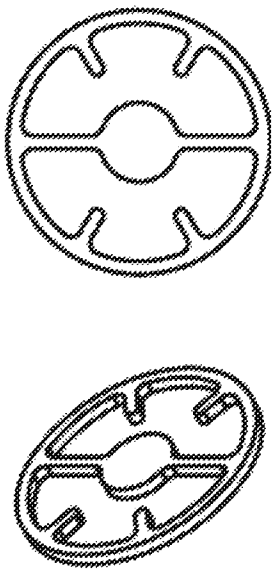

FIGS. 6L and 6M illustrate example plates employing a combination of radial spokes extending from the center to a circumferential ring (three for FIG. 6L and two for FIG. 6M) and also a plurality of spoke segments extending from the circumferential ring toward the center (three for FIG. 6L and four for FIG. 6M). Here again any number of radial spokes and spoke segments can be employed.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A combustion driven hand tool having a control valve between two portions of a combustion chamber in the combustion driven hand tool including a flexible disc affixed to a movable central shaft, wherein by movement of the movable central shaft the control valve is disposed in an open position with a circumferential edge of the flexible disc distal from a valve seat on a wall of the combustion chamber and the control valve is disposed in a dosed position with the circumferential edge of the flexible disc contacting the valve seat, the control valve comprising:

a movable plate affixed to the movable central shaft adjacent the flexible disc and disposed on a same side of the flexible disc as the valve seat to support the flexible disc with the control valve in the closed position such that the flexible disc does not collapse by the valve seat under reverse pressure; and one or more ports through the movable plate affixed to the movable central shaft such that the one or more ports allow combustion pressure to flow freely between the two portions of the combustion chamber with the control valve in the closed position under forward combustion pressure;

wherein the movable plate is movable with the movable central shaft to be distal from the wall of the combustion chamber with the control valve in the open position, there is a break but no gap between the movable plate and the wall of the combustion chamber with the control valve disposed in the closed position configured to pass a flame front through the one or more ports in the movable plate and not between the movable plate and the wall of the combustion chamber.

2. The combustion driven hand tool of claim 1, wherein the movable plate comprises one or more radial spokes having the one or more ports therebetween.

3. The combustion driven hand tool of claim 2, wherein the one or more radial spokes extend to a circumferential ring.

4. The combustion driven hand tool of claim 3, wherein a plurality of radial segments extend from the circumferential ring toward a center of the movable plate.

5. The combustion driven hand tool of claim 1, wherein the movable plate comprises a plurality of parallel slots therethrough forming the ports.

6. The combustion driven hand tool of claim 1, wherein the movable plate comprises a plurality of circular holes therethrough forming the ports.

7. The combustion driven hand tool of claim 1, wherein the central shaft comprises two parts coupled together with the flexible disc and the movable plate sandwiched therebetween.

8. A method of controlling combustion in a combustion driven hand tool having a control valve between two portions of a combustion chamber in the combustion driven hand tool including a flexible disc affixed to a movable central shaft, wherein by movement of the movable central shaft the control valve is disposed in an open position with a circumferential edge of the flexible disc distal from a valve seat on a wall of the combustion chamber and the control valve is disposed in a closed position with the circumferential edge of the flexible disc contacting the valve seat, the method comprising the steps of:

affixing a movable plate to the movable central shaft adjacent the flexible disc and disposed on a same side of the flexible disc as the valve seat to support the flexible disc with the control valve in the closed position allowing combustion pressure to flow freely between the two portions of the combustion chamber with the control valve in the closed position under forward combustion pressure through one or more ports through the movable plate affixed to the movable central shaft; and supporting the flexible disc with the plate such that the flexible disc does not collapse by the valve seat under reverse pressure;

wherein the movable plate is movable with the movable central shaft to be distal from the wall of the combustion chamber with the control valve in the open position, there is a break but no gap between the movable plate and the wall of the combustion chamber with the control valve disposed in the closed position configured to pass a flame front through the one or more ports in the movable plate and not between the movable plate and the wall of the combustion chamber.

9. The method of claim 8, wherein the movable plate comprises one or more radial spokes having the one or more ports therebetween.

10. The method of claim 9, wherein the one or more radial spokes extend to a circumferential ring.

11. The method of claim 10, wherein a plurality of radial segments extend from the circumferential ring toward a center of the movable plate.

12. The method of claim 8, wherein the movable plate comprises a plurality of parallel slots therethrough forming the ports.

13. The method of claim 8, wherein the movable plate comprises a plurality of circular holes therethrough forming the ports.

14. The method of claim 8, wherein the central shaft comprises two parts coupled together with the flexible disc and the movable plate sandwiched therebetween.

* * * * *